US010046564B2

(12) United States Patent
Stathem et al.

(10) Patent No.: US 10,046,564 B2
(45) **Date of Patent: *Aug. 14, 2018**

(54) PRINT HEAD MODULE

(71) Applicant: HEWLETT-PACKARD DEVELOPMENT COMPANY, L.P., Houston, TX (US)

(72) Inventors: Ralph L. Stathem, Lebanon, OR (US); Beverly Asoo Stonas, Albany, OR (US); Sundar Vasudevan, Corvallis, OR (US); Frank Shala, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/960,783

(22) Filed: Dec. 7, 2015

(65) Prior Publication Data

US 2016/0082734 A1 Mar. 24, 2016

Related U.S. Application Data

(63) Continuation of application No. 14/409,999, filed as application No. PCT/US2012/045409 on Jul. 3, 2012, now Pat. No. 9,238,374.

(51) Int. Cl.
*B41J 2/14* (2006.01)
*B41J 2/175* (2006.01)
(Continued)

(52) U.S. Cl.
CPC ..... *B41J 2/1433* (2013.01); *B41J 2/175* (2013.01); *B41J 2/17513* (2013.01);
(Continued)

(58) Field of Classification Search
CPC ..... A61M 2205/7536
See application file for complete search history.

(56) References Cited

U.S. PATENT DOCUMENTS 5,425,889 A 6/1995 Lubitz et al.
6,103,400 A 8/2000 Yamada et al.
(Continued)

FOREIGN PATENT DOCUMENTS

EP 1199176 A1 4/2002
JP 3242982 10/1991
WO WO-2005090085 A2 9/2005

*Primary Examiner* — John P Zimmermann
(74) *Attorney, Agent, or Firm* — HP Inc. Patent Development

(57) ABSTRACT

A print head module for delivering ink to a print head comprising a module venting system comprising a one-time vent built into the interior of the print head module in which, when an amount of ink comes in contact with the one-time vent, air is prevented from passing through the one-time vent. A system for delivering ink to a print head comprising a print head, a external reservoir of ink, and a print head module comprising a one-time vent built into the interior of the print head module and fluidly coupling the print head to the external reservoir of ink, in which, when an amount of ink comes in contact with the one-time vent within the print head module, air is prevented from passing through the one-time vent.

19 Claims, 9 Drawing Sheets

(51) Int. Cl.
*B41J 29/377* (2006.01)
*B41J 2/19* (2006.01)

(52) U.S. Cl.
CPC ..... *B41J 2/17553* (2013.01); *B41J 2/19* (2013.01); *B41J 29/377* (2013.01)

(56) References Cited

U.S. PATENT DOCUMENTS

| | | | |
|---|---|---|---|
| 6,196,669 | B1 | 3/2001 | Harvey et al. |
| 6,203,146 | B1 | 3/2001 | Pawlowski, Jr. et al. |
| 6,250,747 | B1 | 6/2001 | Hauck |
| 6,318,851 | B1 | 11/2001 | Hoen et al. |
| 6,530,653 | B2 | 3/2003 | Le et al. |
| 6,682,772 | B1 | 1/2004 | Fox et al. |
| 6,739,706 | B2 | 5/2004 | Barinaga et al. |
| 6,935,730 | B2 | 8/2005 | Qingguo et al. |
| 7,303,265 | B1 | 12/2007 | Delametter et al. |
| 7,420,319 | B2 | 9/2008 | Kastl et al. |
| 8,079,691 | B2 | 12/2011 | Koehler et al. |
| 2002/0041305 | A1 | 4/2002 | Tsukuda |
| 2002/0044183 | A1 | 4/2002 | Mou |
| 2002/0179527 | A1 | 12/2002 | Yao |
| 2004/0052689 | A1 | 3/2004 | Yao |
| 2007/0126823 | A1* | 6/2007 | Silverbrook et al. ..... 347/86 |
| 2007/0222828 | A1 | 9/2007 | Stathem et al. |
| 2008/0257153 | A1 | 10/2008 | Harp |
| 2009/0239436 | A1 | 9/2009 | Ohnstad et al. |
| 2009/0320684 | A1 | 12/2009 | Weaver et al. |
| 2010/0112233 | A1 | 5/2010 | Iwamoto et al. |
| 2010/0177914 | A1 | 7/2010 | Heite et al. |
| 2010/0289856 | A1 | 11/2010 | Yamamoto et al. |
| 2013/0050356 | A1 | 2/2013 | Stathem |
| 2013/0076809 | A1 | 3/2013 | Gonzales |
| 2013/0271538 | A1 | 10/2013 | Boyd |

* cited by examiner

PRINT HEAD MODULE

BACKGROUND

Print modules may come in various forms, but may be grouped into two types: those that comprise a supply of ink within them and those that both hold a supply of ink inside the print head as well as include an exterior supply of ink in a reservoir distant from the moving print module and print head. These two types of print modules are often referred to as "on-axis" and "off-axis" print modules respectively. With some off-axis print modules, a supply of ink is provided to the moving print module by a tube leading from the supply to a port in the print module. With other off-axis print modules, the supply of ink may be provided to the moving print module by both an existing supply of ink within the print module as well as the exterior reservoir of ink. In both cases, however, issues may arise after installation of either type of these off-axis print modules. Specifically, if the proper steps are not taken, air may be introduced into the module that may eventually effect the operations of the print head. Even further, an off-axis print module that is provided to a consumer with ink present in it may structurally compromise the components of the print module over time. Still further, if the consumer purchases a print module that includes an internal supply of ink therein, the consumer may have to purchase a number of different modules based on which colors will be used in the printing process.

BRIEF DESCRIPTION OF THE DRAWINGS

The accompanying drawings illustrate various examples of the principles described herein and are a part of the specification. The examples do not limit the scope of the claims.

Throughout the drawings, identical reference numbers designate similar, but not necessarily identical, elements.

DETAILED DESCRIPTION

Figure 1:
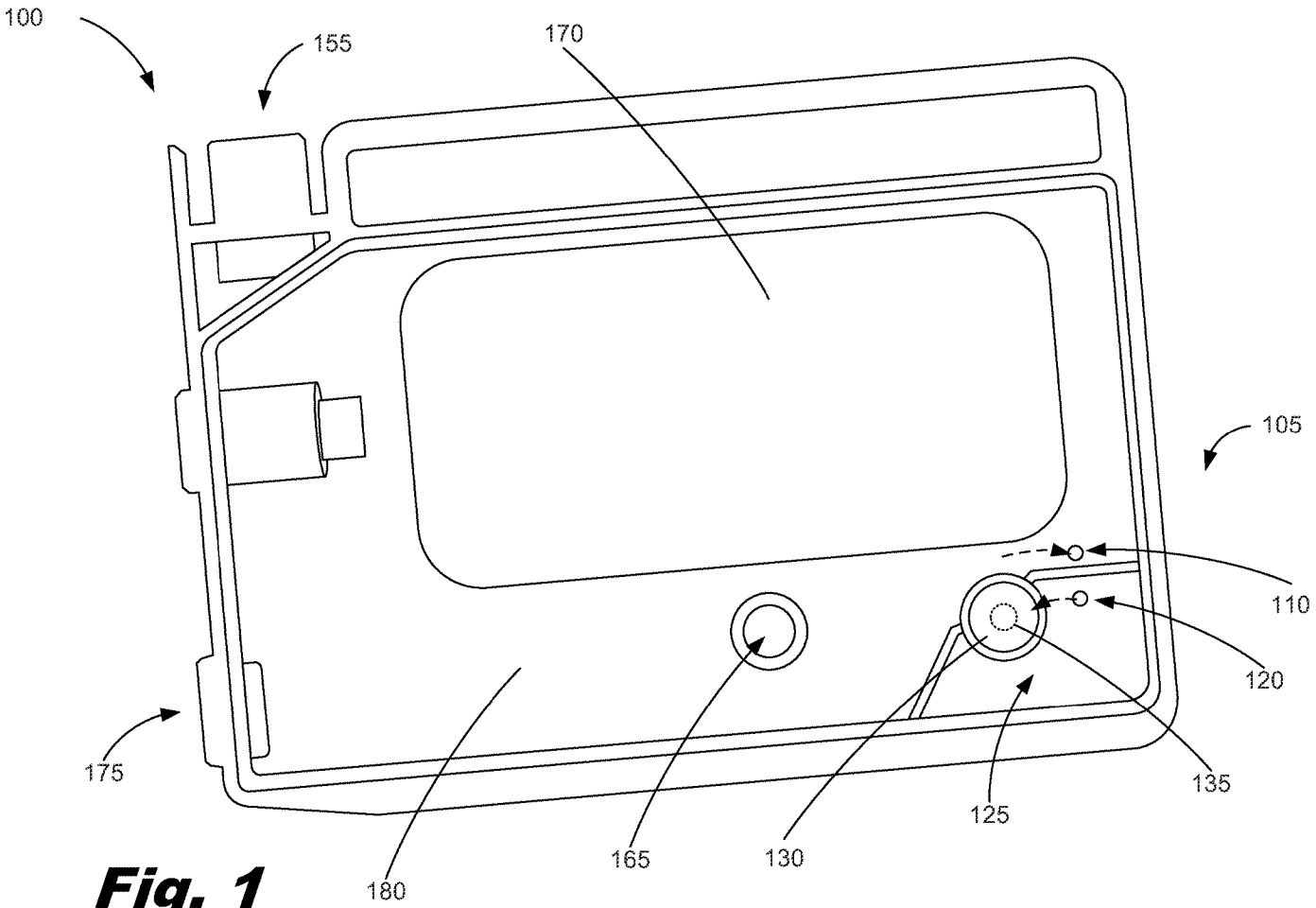
FIG. 1 is a cross-sectional diagram of a print head module according to one example of principles described herein.

As described above, off-axis print modules include a supply of ink within the housing of the print module. In some cases, an exterior source of ink may supplement this relatively smaller amount of ink. However, in either case, the consumer will have to purchase a print module that contains ink. One issue that may arise in this situation is the eventual degradation of the components of the print module over time. As ink sits inside the module, the ink itself may degrade components of the module. Even if the user were to purchase the module well before the suggested expiration date of the module, the time the ink has been in the module before the consumer has had a chance to use the module has already reduced the length of time a user can operate the printer with that module.

Still further, if a user were to purchase an ink module with a supply of ink included in the module, the user may have to purchase a number of other modules based on the colors the user will be using during printing. Consequently, a user would purchase a different part number for each color operating on that printer. Eventually these parts will fail and have to be replaced, to which the user would go through the laborious process of looking up a specific part number and order that part number. Because a print head may include any number of print modules holding different colors in them, any number of different part numbers would have to be purchased over the lifetime of the printer. As the age of the printer increases, the availability of these parts may decrease resulting in either the user having to print without that color or purchase an entire new printing system.

Off-axis print heads that include these print modules may also include an exterior reservoir of ink attached to the module so as to supply a constant and larger amount of ink to the module. After a certain module has outlived its usefulness, it may be replaced with a new one. Before a new module can be attached to the exterior source of ink, the air contained in the tubes leading from the exterior ink reservoir as well as some parts of the module should be bled out so as to avoid damaging the printing system or risk producing an inferior printed product. A relatively messy, time consuming and labor intensive startup process may be initiated by the user when switching out these modules. The time and effort to initiate and complete this startup process results in the printer being down for a length of time. Further, extra man hours may be spent to replace the part than would otherwise be spent. Consequently, this may result in lost revenue as well as any monetary losses associated with having to train and pay a person to complete this lengthy process for each module within the print head. As a result productivity may drop.

The present specification, therefore, describes a print head module for delivering ink to a print head comprising a module venting system comprising a one-time vent built into the interior of the print head module in which, when an amount of ink comes in contact with the one-time vent, air is prevented from passing through the one-time vent. The present specification further describes a method of venting air from a print head module of a print head, comprising hyperinflating a bladder within the module, pushing an amount of ink and air from an external reservoir to the module until the ink contacts a one-time valve located within the print head module, and deflating the bladder in which, when an amount of ink comes in contact with the one-time vent, air is prevented from passing through the one-time vent.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language indicates that a particular feature, structure, or characteristic described in connection with that example is included as described, but may not be included in other examples.

Figure 2:
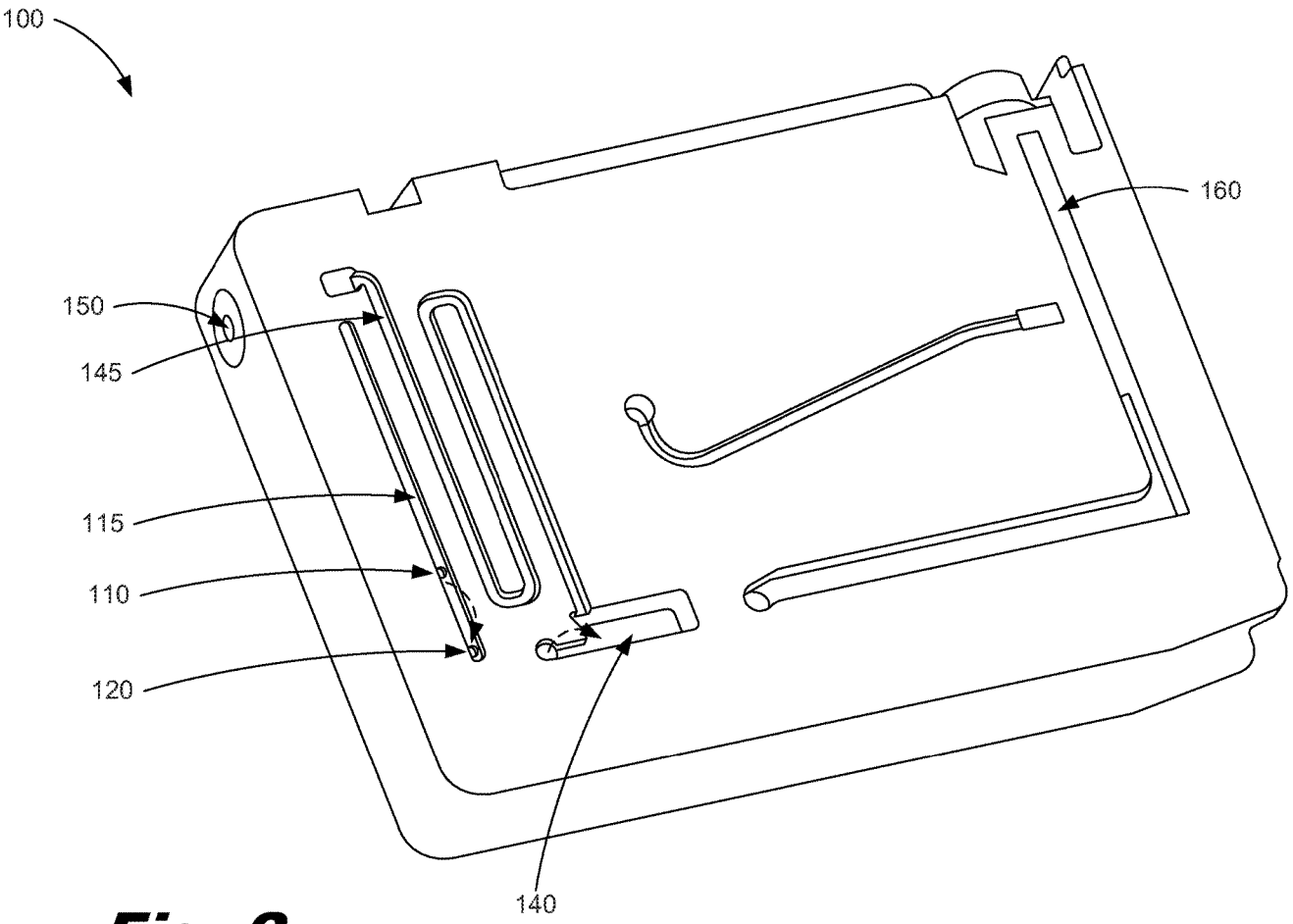
FIG. 2 is an exterior side view of the print head module of FIG. 1 according to one example of principles described herein.

FIG. 1 is cross-sectional diagram of a print head module (100) according to one example of principles described herein. FIG. 2 is an exterior side view of a print head module (100) of FIG. 1 according to one example of principles described herein. The print head module (100) comprises a module venting system (105). The module venting system (105) may comprise a vent entrance (110), a vent channel (FIG. 2, 115), a module bypass hole (120), a vent cavity (125), a one-time vent (130), a vent hole (135) positioned behind the one-time vent (130), a vent ink catchment (140), a vent overflow channel (145), and a vent exit (150). The module (100) may also include an ink port (155), an ink channel (160), a regulator and check valve (165), a bladder (170), and a print head port (175). As will be discussed later the module venting system (105) provides for a module (100) that can be installed into a print head in a dry state and allow a user to initiate a start-up sequence which will introduce an amount of ink into the module (100) for the first time. During the start-up process, the module (100) allows air to exit the module (100) until an amount of ink comes in contact with the one-time valve. After the initial set-up the module (100) may continue to be replenished with ink via an external ink supply. Each of the above mentioned elements will now be described in more detail with reference to both FIGS. 1 and 2.

The ink port (155) may be formed to receive an amount of ink from an external source. In one example, the ink may be provided to the module (100) via the ink port (155) under pressure. The positive pressure may provide the module (100) with an ink supply that may be constantly replenished when the ink level within the module (100) reaches a predetermined point.

From the ink port (155), the ink may proceed through an ink channel (FIG. 2, 160) to a regulator and check valve (165). The regulator and check valve (165) helps to regulate the amount of ink within the module (100) by cutting off the flow of ink into the module (100) when the amount of pressure within the module (100) reaches a predetermined threshold. The regulator and check valve (165) also prevent ink from flowing in the opposite direction and back into the reservoir of ink or into the ink channel (FIG. 2, 160). The ink channel (FIG. 2 160) may be defined in the outside wall of the module (100) on three sides. The fourth outside wall may be formed out of a clear plastic film coupled to the module (100). The clear film may provide a user of the module (100) with the ability to quickly determine if air or other contaminants are entering into the module (100). In one example, the clear film may be replaced with a solid opaque layer coupled to the module (100).

The inside of the module (100) may include an interior reservoir (180) into which the ink may flow and collect for later use by the print head system. A bladder (170) may also be provided within the module (100) to control the pressure within the module (100). As will be explained later, the pressure within the module (100) may be controlled so as to provide the print head with the appropriate amount of ink under the appropriate conditions. Either too much or too little ink pressure may produce an inferior printed product and the bladder (170) may be inflated or contracted appropriately as determined by the pressure within the module (100). Additionally, the bladder (170) may be used in both the start-up process and ink burping process to clear the system of air.

The print head port (175) may be situated at the lowest part of the module (100) and may provide the print head with ink. In one example, both the print head port (175) and ink port (155) may include a rubber self sealing cap into which needles in fluid communication with the ink reservoir and print head may enter the print head port (175) and ink port (155). This may allow the print head port (175) and ink port (155) to drain ink from and add ink to the module (100) respectively.

The module (100) also comprises a module venting system (105). The module venting system (105) allows a new module (100) to be installed into the print head system without any ink included in the module (100). As discussed above, this provides many advantages a number of which have already been described. As the ink source is fluidly coupled to the module (100) via the print head system, any air within the ink reservoir or the tubes leading to the module (100) may be bled out using the start-up procedure. The air may be allowed to enter the module (100) via the ink port (155), the ink channel (160), and into the module (100) through the regulator and check valve (165). The air is then pushed out through the module venting system (105). Specifically, the air may first enter into vent entrance (110). The vent entrance (110) is a hole defined in the body and located towards a side of the module (100) that is a distance from where the ink enters the module (100). The vent entrance (110) allows the air to flow into the vent channel (FIG. 2, 115) located on the same exterior surface of the module (100) as that of the ink channel (160). Like the ink channel (160) the vent channel (FIG. 2, 115) may be covered and with a clear plastic film to prevent any ink from later dripping out of the channel (FIG. 2, 115). The air may then proceed down the vent channel (FIG. 2, 115) and into the module bypass hole (120). The module bypass hole (120) may comprise a hole defined in the body of the module (100) which leads back into the module (100). The module bypass hole (122) may lead back into a segregated vent cavity (125) within the module (100).

The air may then proceed through a one-time vent (130) and a vent hole (135) positioned behind the one-time vent (130). The one-time vent (130) is permeable to fluids such as air and therefore the air is allowed to flow freely through it and proceed to exit the module (100) again through the vent hole (135). Once past the vent hole (135), the air is allowed to pass into the vent ink catchment (140) and through the vent overflow channel (145). A vent exit (150) is defined in the body of the module (100) so as to allow the air to escape.

Figure 3:
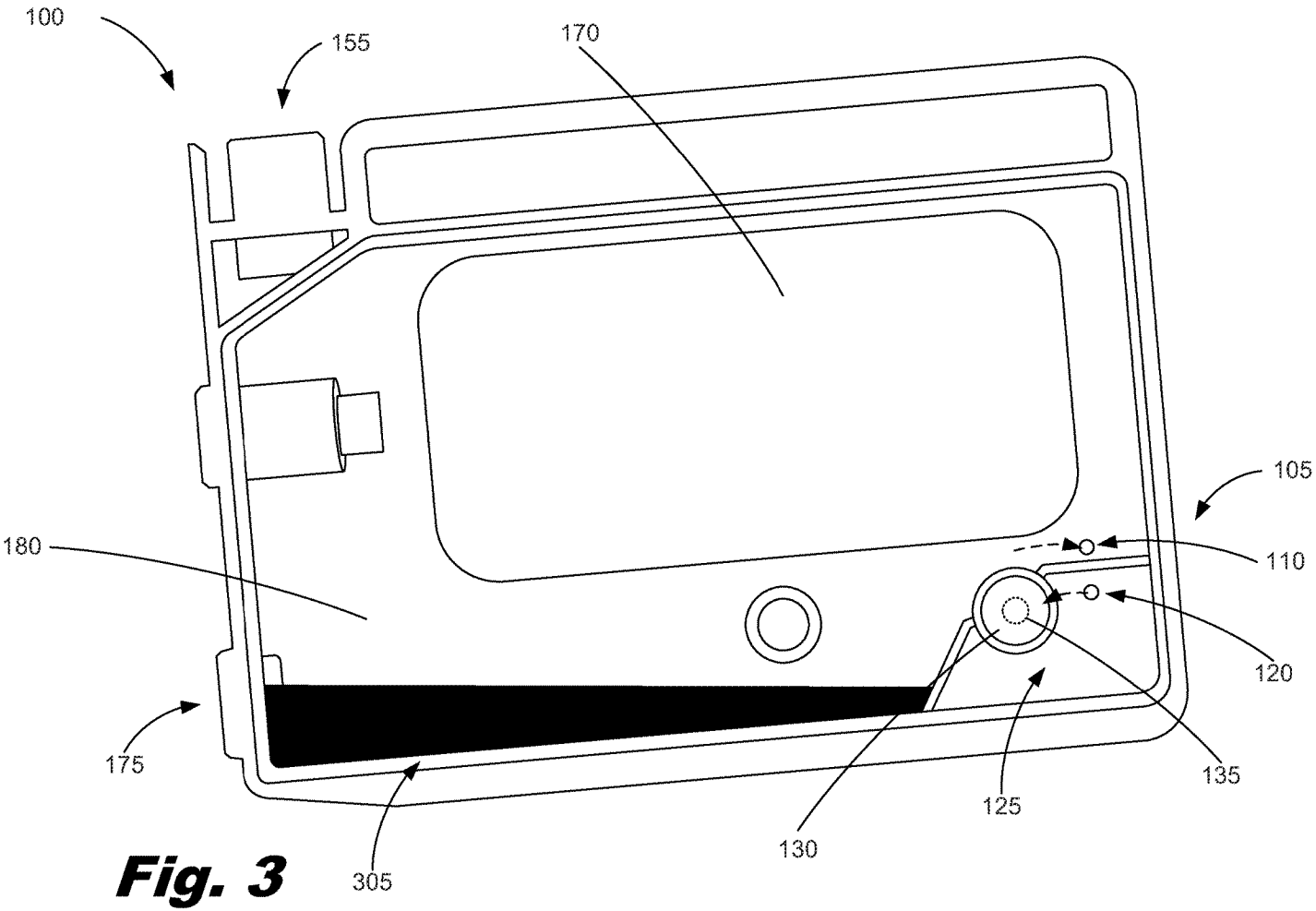
FIGS. 3-5 show the progression of a start-up process as additional amounts of ink are pumped into the module of FIG. 1 according to one example of the principles described herein.
Figure 4:
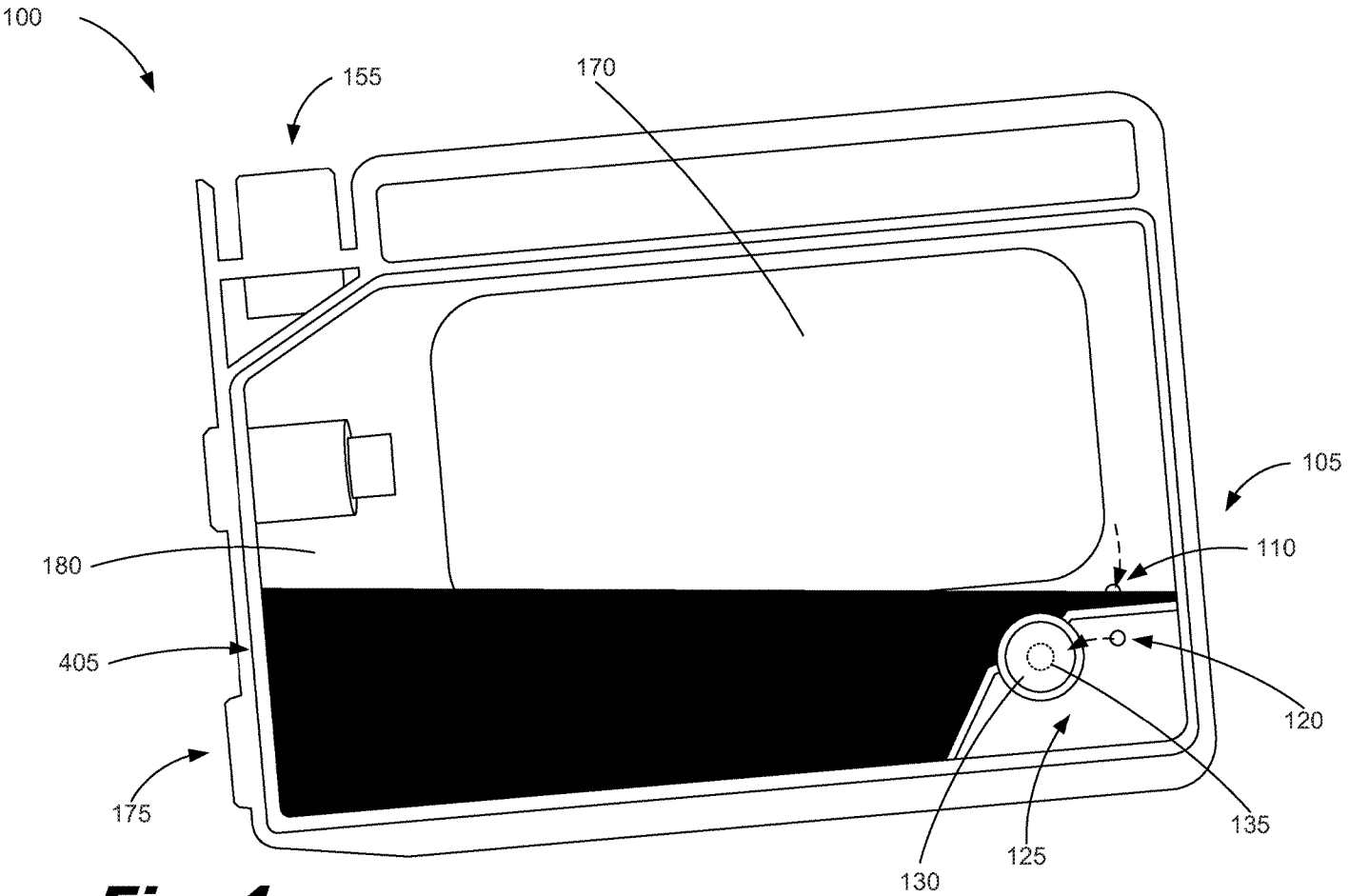
Figure 5:
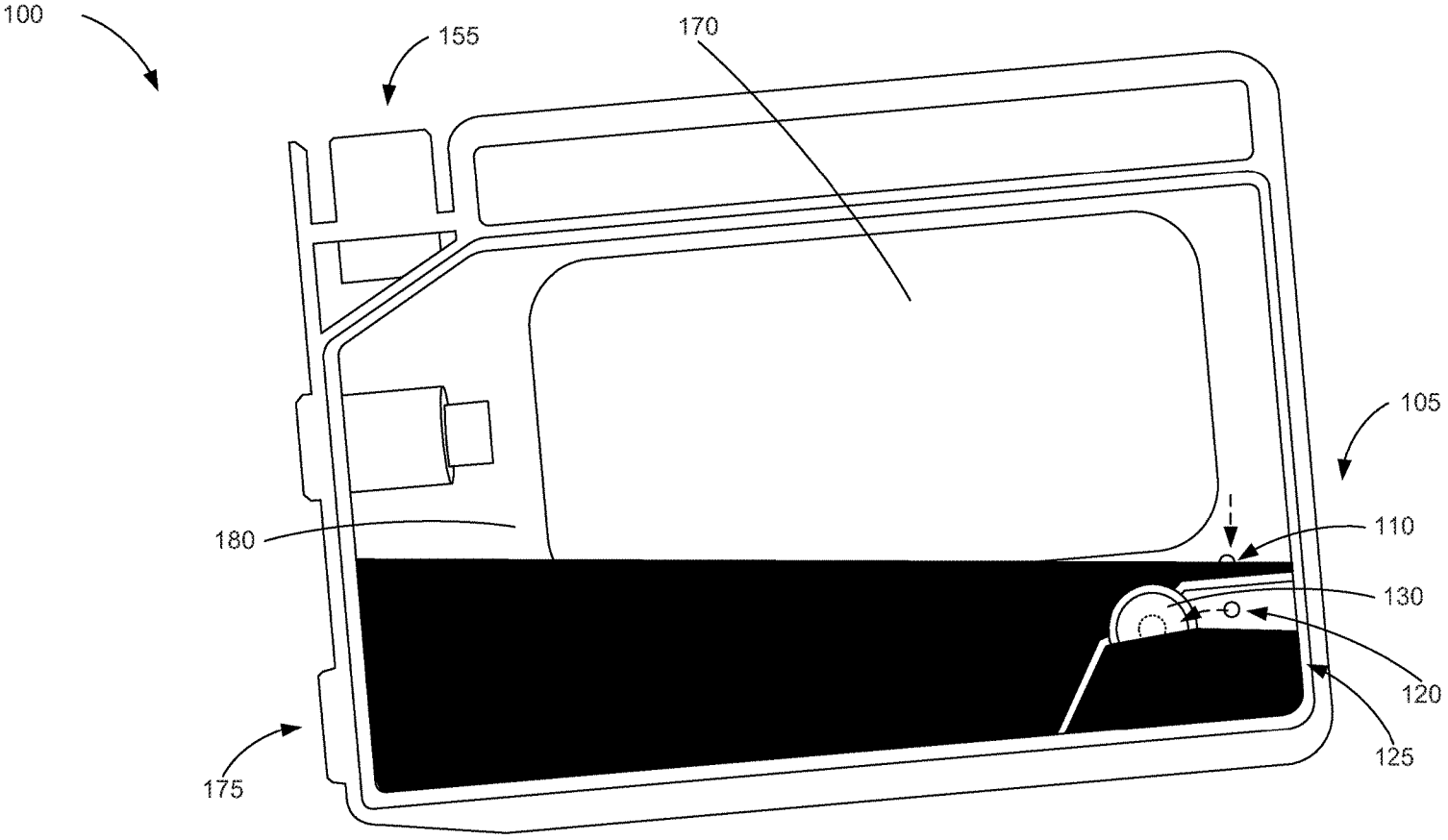

During the initial stages of the start-up sequence, the system may push an amount of air out of the various parts and through the module (100). Dashed arrows have been placed in FIGS. 1 and 2 to show the flow of air through the module (100). Once the air has been evacuated from the system, ink is allowed to flow into the interior reservoir (180) and begin to fill the module (100) with a supply of ink. While the ink is flowing into the interior reservoir (180), additional amounts of air are also being pushed out using the same path as described above. FIGS. 3-5 show the progression of the start-up process as additional amounts of ink are pumped into the module (100) of FIG. 1. Specifically, FIG. 3 shows a first amount of ink (305) collecting in the interior reservoir (180). As the ink fills the module (100), it displaces an amount of air and forces the air through the module venting system (105) as described above and as indicated by the dashed arrows.

FIG. 4 shows that the ink level has increased to a second level (405) and has also reached the height of the vent entrance (110). As the ink level reaches the level of the vent entrance (110), ink begins to follow the same path as the air had taken while being forced out of the module (100). This path is also indicated by dashed arrows. Specifically, the ink may proceed to flow through the vent entrance (110) and into the vent channel (FIG. 2, 115). As described above, the ink follows down the vent channel (FIG. 2, 115) and reenters the module (100) via the module bypass hole (120).

FIG. 5 shows the vent cavity (125) filling as ink is pushed through the module bypass hole (120). In one example, as the ink comes in contact with the one-time vent (130), the ink is slowed down or completely stopped from exiting through the vent hole (135).

In one example, the one-time vent (130) may be chemically treated such that when it comes in contact with a liquid such as ink, the chemicals in the one-time vent (130) coagulate or swell and form a plug such that ink is not allowed to pass through. The one-time vent (130) may be treated with, for example, a crosslinked polyacrylamide. As the water in the ink comes in contact with the crosslinked polyacrylamide, the one-time vent (130) may swell. In another example, a portion of the one-time vent (130) closest to the vent hole (135) may be treated with crosslinked polyacrylamide. As the ink comes in contact with the front of the one-time vent (130) and is pushed through to the chemically treated portion, the chemicals may react with the ink as described above and create a solid plug. In this example, treating only a portion of the one-time vent (130) and specifically the back portion of the one-time vent (130) may provide additional advantages. Some chemicals used to treat the one-time vent (130) may leach into the ink, and, during normal operation of the module (100), may be used to print with. Treating the back portion of the one-time vent (130) may prevent those chemicals from leaching into the supply of ink.

The one-time vent (130) may also be treated with a number of other chemicals. These chemicals may include crosslinked polyacrylic acid, polyacrylamide, polyacrylic acid, carboxymethyl cellulose (CMC), styrene maleic anhydride (SMA), or combinations thereof. Additional chemicals may be used to cause either the coagulation of pieces of the one-time vent (130) or the swelling of the one-time vent (130). In either case, the chemicals used interact with the chemicals found in the ink and cause the one-time vent (130) to close off. Examples of such chemicals include other homo- or co-polymers of maleic anhydride. Still further, similar effects may be achieved by two part chemical compositions. For example, an amount boric acid may be sandwiched between a number of layers of polyvinyl alcohol (PVA) such that when ink flows through one part of the PVA and reaches the amount boric acid, the boric acid dissolves in the ink and cross-links the PVA thereby providing a seal to prevent backflow. Other two part chemical reactions may be used to produce similar effects.

The vent cavity (125) may also prevent any contaminated ink from contaminating the ink supply within the module (100). Specifically, the placement of the vent cavity (125) at a low part within the module (100) may prevent any contaminated ink from flowing in the opposite direction and into the interior reservoir (180).

In another example, the one-time vent (130) may comprise a vent plug having very small pores. The small pores may allow air to freely flow through the one-time vent (130) but as ink comes in contact with the one-time vent (130), the ink is slowed down due to the size of the pores. Additionally, as ink comes in contact with the one-time vent (130) the pores prevent the air from passing either in or out of the module (100).

Still further, during operation of the system, the pressure within the module (100) may be adjusted relative to the atmospheric pressure. Because the ink has been allowed to slowly pass through the one-time vent (130) an amount of ink may be present in the vent ink catchment (140) and vent overflow channel (145). As the pressure inside the module (100) becomes negative, this may cause the air and ink within the vent ink catchment (140) and vent overflow channel (145) to be sucked back into the module (100). However, the meniscus created by the pores within the one-time vent (130) will prevent at least the air from flowing back into the module (100) via the vent hole (135).

In some of the examples above, some ink may pass through the one-time valve (130) before the one-time valve (130) has sealed off or has otherwise prevented additional amounts of ink to pass through. In these cases, a vent ink catchment (140) and a vent overflow channel (145) allow the module (100) to catch that ink before it leaks out the vent exit (150). The internal area of the vent ink catchment (140) and vent overflow channel (145) may be adjusted to provide an amount of space for ink to overflow into. The chosen volumetric area of the vent ink catchment (140) and vent overflow channel (145) may be based on the intended use of the module (100) as well as other physical parameters associated with the module (100).

For instance, in the example where the one-time vent (130) includes relatively small pores through which ink, but no air, is allowed to pass through, the vent ink catchment (140) and vent overflow channel (145) may provide an area into which an amount of ink may flow when the pressure within the module (100) is being adjusted. During operations of the module (100) the pressure may be adjusted for a number of reasons. In some cases the internal pressure may increase causing an additional amount of ink to flow through the porous vent plug of the one-time vent (130). As this happens, an additional amount of ink may overflow into the vent ink catchment (140) and vent overflow channel (145). Throughout the useable life of the module (100), the vent ink catchment (140) and vent overflow channel (145) may serve as a reservoir for the module (100). Under negative pressure, the ink may be retracted back into the interior reservoir (180) of the module (100) and the vent ink catchment (140) and vent overflow channel (145) may be used to supply this amount of ink.

In another example, the vent ink catchment (140) and vent overflow channel (145) may serve as an indicator to a user of the print head that ink has come in contact with the one-time vent (130). As such the user or repairman will understand that the one-time vent (130) has been sealed off. Therefore, while a repairman is looking into any issues that may have arisen during operation of the print head and module (100), the repairman will understand that ink in the vent ink catchment (140) or vent overflow channel (145) is indicative that the one-time vent (130) has come in contact with the ink supply in the module (100). The repairman may then look to other solutions to solve any maintenance issues with the print head or module (100).

Figure 6:
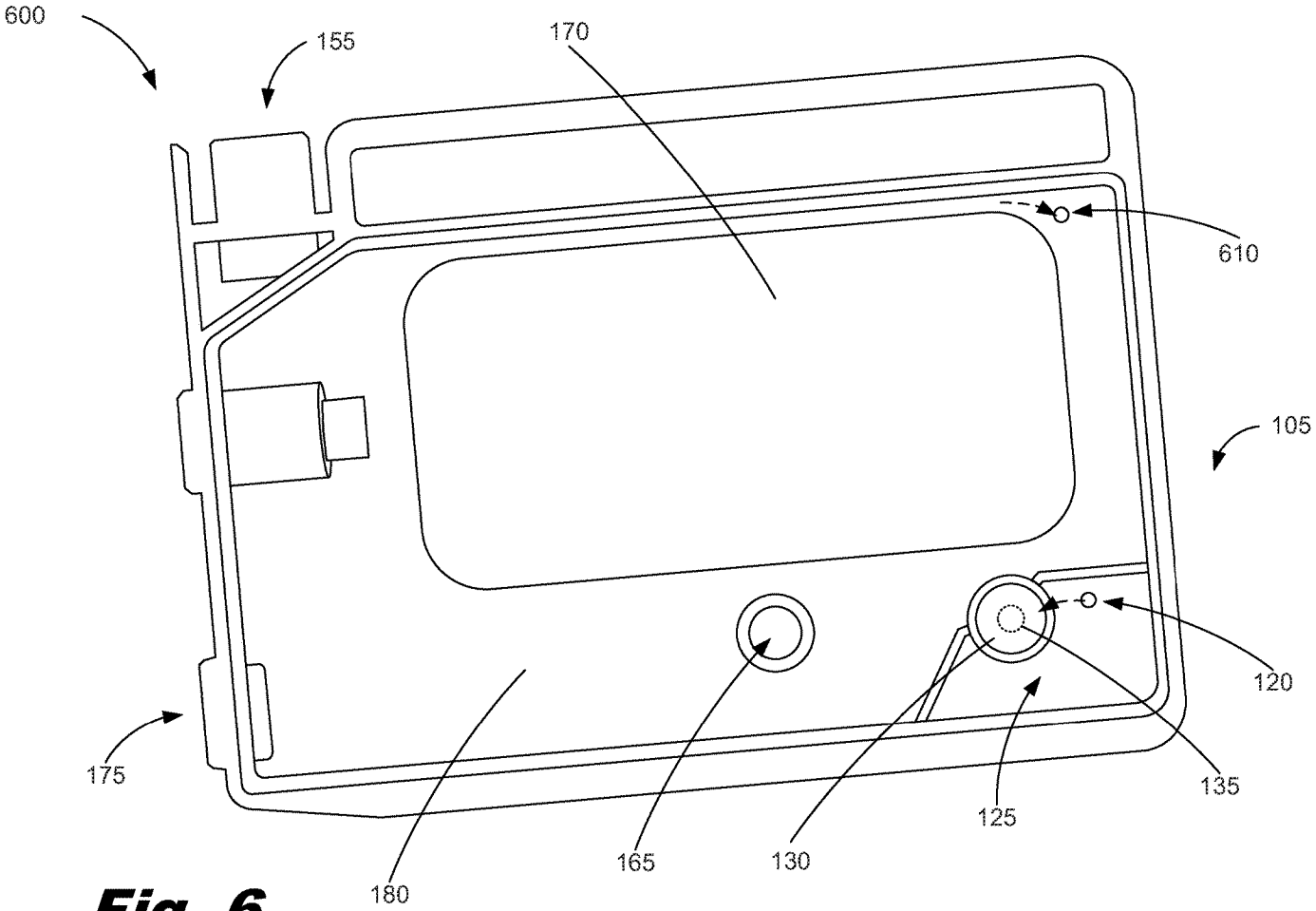
FIG. 6 is a cross-sectional diagram of a print head module according to another example of principles described herein.

FIG. 6 is a cross-sectional diagram of a print head module (600) according to another example of principles described herein. The print head module (600) is similar to the module (100) of FIG. 1 except for the adjustment of the vent entrance (610). In FIG. 6, the vent entrance (610) has been created at a relatively higher position within the module (100). The placement of the vent entrance (610) at this location allows a larger amount of ink to be added into and retained within the interior reservoir (180) of the module (100). Other examples exist where the vent entrance (100, 610) is located at different heights along the vent channel (FIG. 2, 115). During operation of the print head, a relatively larger amount of one color of ink may be used in comparison to the other colors included in the other modules (100) coupled to the print head. Those colors that are used more often by the print head may have a vent entrance (110, 610) that is defined within the body of the module (100) at relatively higher locations along the vent channel (FIG. 2, 115). This may provide the system with a larger amount of ink for that specific color. Those colors that are used relatively less often may be provided with a vent entrance (110) that is defined at a lower position along the vent channel (FIG. 2, 115) as shown in FIG. 1.

Figure 7:
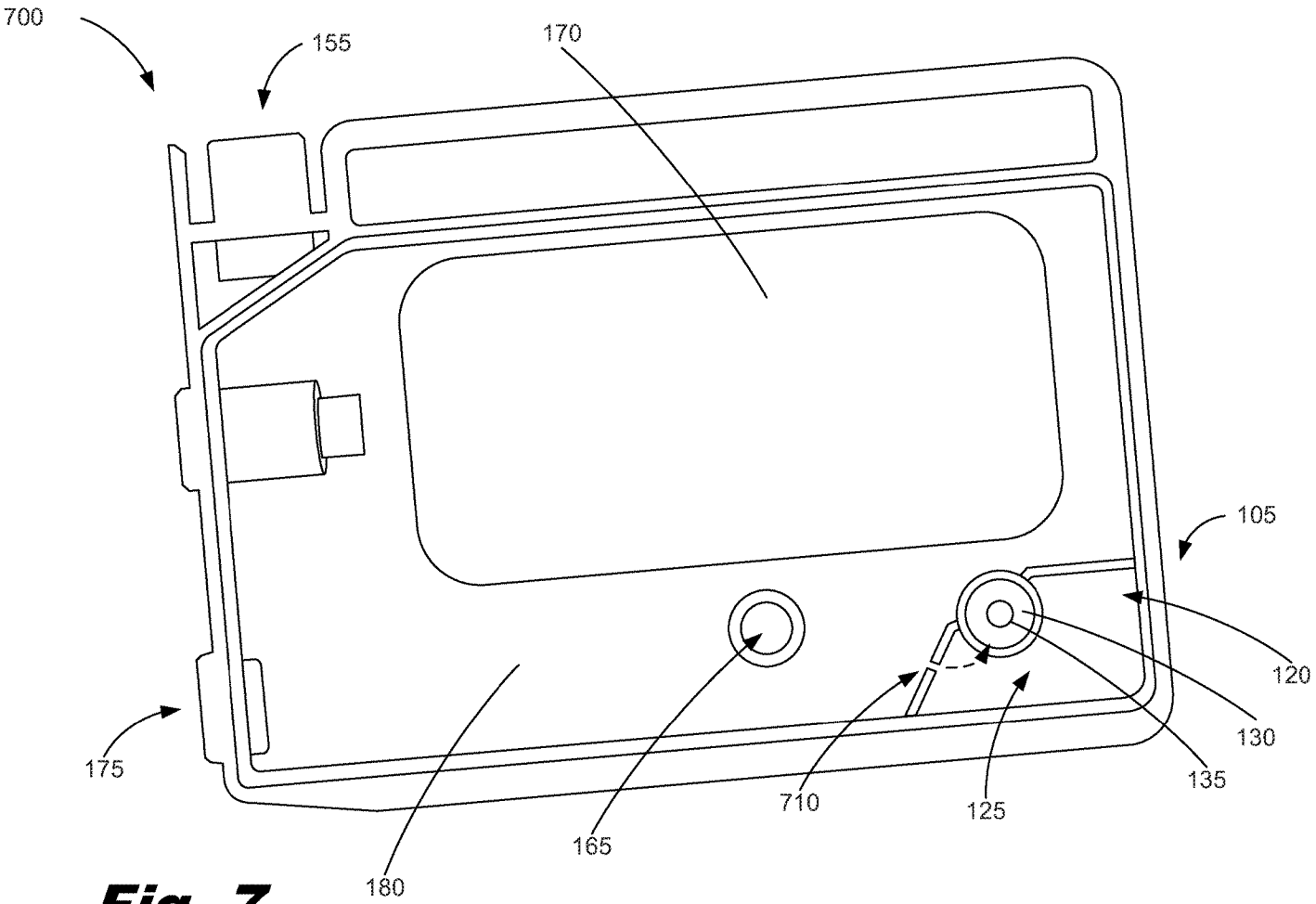
FIG. 7 is a cross-sectional diagram of a print head module according to another example of principles described herein.

FIG. 7 is a cross-sectional diagram of a print head module (700) according to another example of principles described herein. Similar to the modules (100, 600) in FIGS. 1 and 6, FIG. 7 also includes a vent entrance (710) that allows ink to flow towards the one-time vent (130). In this example, the module (100) does not include a vent channel (FIG. 2, 115) or a module bypass hole (120). Instead the vent entrance (710) is located relatively lower than the vent entrance (110) in FIG. 1. In this example, the vent entrance (710) is defined along the exterior wall of the vent cavity (125). The ink is allowed to flow into the vent cavity (125) and come in contact with the one-time vent (130) as described above in connection with FIGS. 1 and 6. In this example, the ink level may be maintained at an even lower level within the module (700) as that shown in FIG. 1.

Figure 8:
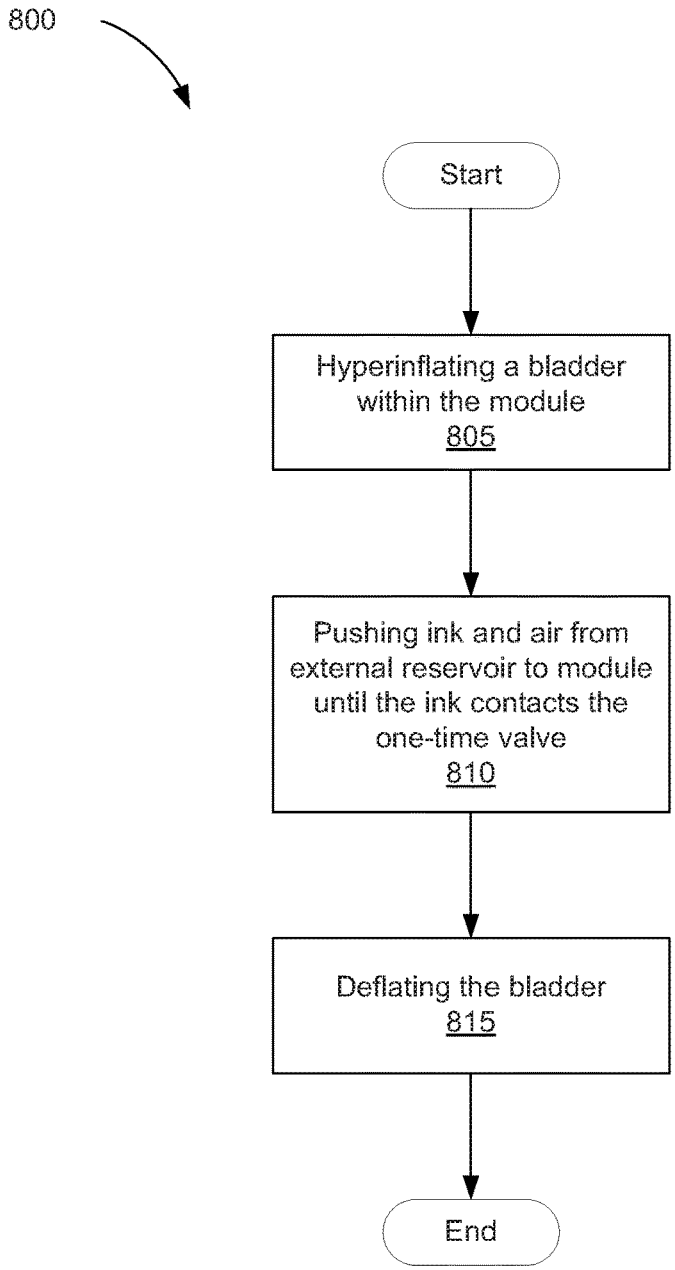
FIG. 8 is a flowchart showing a method of initiating and completing a start-up process using a one-time vent according to one example of principles described herein.

FIG. 8 is a flowchart showing a method (800) of initiating and completing a start-up process using a one-time vent according to one example of principles described herein. The method (800) may begin with hyperinflating (805) the bladder (FIG. 1, 170) within the module (FIG. 1, 100). During operation of the module (FIG. 1, 100), the bladder (FIG. 1, 170) may be about 70% full of air. The pressure produced inside the module (FIG. 1, 100) when the bladder (FIG. 1, 170) is 70% full of air is sufficient to actuate the regulator and check valve (FIG. 1, 165). This allows ink to flow into the module (FIG. 1, 100) on demand via the selective increase or decreasing of the pressure within the bladder (FIG. 1, 170). During other times, the bladder (FIG. 1, 170) may be vented to atmospheric pressure.

However, during the hyperinflation (805) of the bladder (FIG. 1, 170), the bladder (FIG. 1, 170) may be pressurized to about 100 to 150 inches of pressure. When this occurs, the regulator and check valve (FIG. 1, 165) is opened. The ink and air within the lines and ink reservoir attached to the module (FIG. 1, 100) is pushed (810) from the external reservoir and into the module (FIG. 1, 100).

The module is then filled with an amount of ink. Once the one-time vent (FIG. 1, 130) comes in contact with the ink, the bladder (FIG. 1, 170) may be deflated (815). In one example, the bladder (FIG. 1, 170) may be deflated till it is 70% full as described above. Because the ink supply from the external ink reservoir is under pressure, a constant amount of ink may flow into the module (FIG. 1, 100) except when the pressure inside the module (FIG. 1, 100) becomes a negative pressure that is sufficient to close off the regulator and check valve (FIG. 1, 165). In this case, that pressure may be maintained when the bladder (FIG. 1, 170) is about 70% full.

In one example, a routine may be built into the printing system that may sense if the module (FIG. 1, 100) has recently been installed. A recently installed module (FIG. 1, 100) may be indicative of the fact that the tubes from the reservoir to the module (FIG. 1, 100) contain air within them. The routine may then initiate the above start-up process described above (805-815). During the routine, the print system may be able to monitor and regulate the amount if ink that is being pumped into the module (FIG. 1, 100). After a predetermined amount has been pumped into the module (FIG. 1, 100), the routine may then cause the bladder (FIG. 1, 170) to deflate to 70% air capacity.

In one example, the method (800) may also include a burping process. The print head to which the module (FIG. 1, 100) is coupled to may also contain an amount of air therein. After the bladder (FIG. 1, 170) has been deflated (815) the print system may also burp air out of the print head by momentarily positively pressurizing the inside of the module (FIG. 1, 100). The additional pressure may be provided by inflating the bladder (FIG. 1, 170). This causes ink to flow into the print head and, upon release of that pressure, causes the air to be brought back into the module (FIG. 1, 100).

Figure 9:
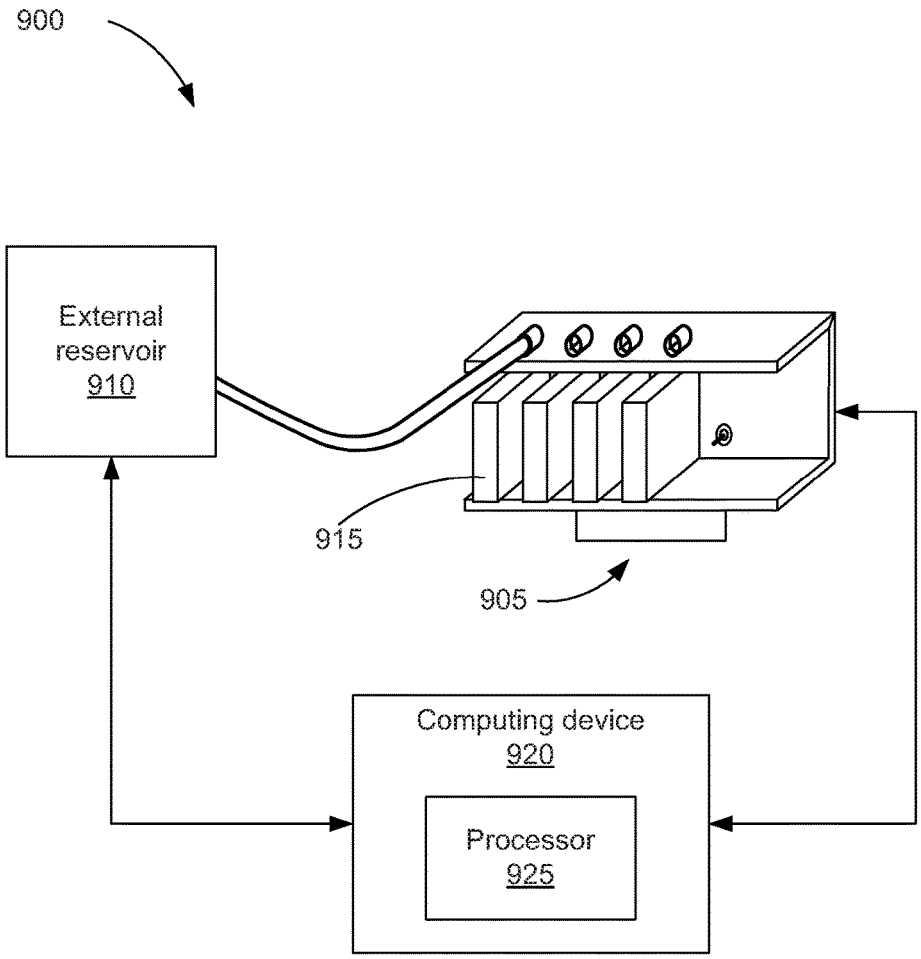
FIG. 9 is a block diagram showing a print head system incorporating the print head module of FIG. 1 according to one example of the principles described herein.

FIG. 9 is a block diagram showing a print head system (900) incorporating the print head module of FIG. 1 according to one example of the principles described herein. The system (900) may include an ink reservoir (910) a print head (905) with a number of print head modules (915) fluidly coupled to the print head. A computing device (920) with a processor (925) that may receive computer program instructions that cause the system (900) to complete the method described above in FIG. 8.

The present specification further includes a computer program product for initiating and completing a start-up process using a one-time vent, The computer program product may comprise a computer readable storage medium having computer usable program code embodied therewith. The computer usable program code may comprise computer usable program code to, when executed by a processor, cause the bladder (FIG. 1, 170) within the module (FIG. 1, 100) to hyperinflate thereby allowing an amount of ink into the dry module (FIG. 1, 100). The computer usable program code may also comprise computer usable program code to, when executed by a processor, cause the ink and air within the external ink supply and the lines from the ink supply to the module (FIG. 1, 100) to be pushed into the module (FIG. 1, 100). The computer usable program code may also comprise computer usable program code to, when executed by a processor, cause a predetermined amount of ink to be pushed into the module (FIG. 1, 100) until the ink comes in contact with the one-time vent (FIG. 1, 130). Still further, the computer usable program code may comprise computer usable program code to, when executed by a processor, cause the bladder (FIG. 1, 170) within the module (FIG. 1, 100) to deflate thereby causing the flow of ink into the module (FIG. 1, 100) to stop. Even further, the computer usable program code may also comprise computer usable program code to, when executed by a processor, cause the air within the print head coupled to the module (FIG. 1, 100) to be burped from the print head.

The specification and figures describe a print head module (100) for delivering ink to a print head comprising a one-time vent (130). This print head module (100) may have a number of advantages. Specifically, the use of the print head module (100) as described above allows a user to cleanly and effectively switch out print head modules (100) as the modules (100) coupled to the print head outlive their useful life.

Additionally, the module (100) may be provided to the user dry meaning that the module is purchased without an ink source included inside the module. This allows a user to purchase one part for all colors the user intends to print with on the printing system.

The dry module (100) additionally allows the user to insert the tube from the external ink source to the module (100) without first having to bleed any air out of the reservoir or the tubes. Similarly, the single module (100) may allow a manufacturer to manage less parts because a single or relatively more limited number of parts may be used to construct the module (100). This provides an added advantage during the manufacturing processes.

Still further, air within the tubes can be eliminated without using extra parts or user intervention. Even further, the parts within the module (100) will not be subjected to the deteriorating effects of the ink before the user purchases the module (100) as no ink is present in the module (100) until the module is installed and in use.

The preceding description has been presented to illustrate and describe examples of the principles described. This description is not intended to be exhaustive or to limit these principles to any precise form disclosed. Many modifications and variations are possible in light of the above teaching.

What is claimed is:

1. A print head module for delivering ink to a print head comprising:

a vent cavity defined within an interior cavity of the print head module, the interior cavity serving as a reservoir of ink and being separated from the vent cavity by an interior wall; and a one-time vent built into the vent cavity of the print head module;

in which, when an amount of ink comes in contact with the one-time vent via an interior wall bypass structure, air is prevented from passing through the one-time vent.

2. The print head module of claim 1, further comprising: wherein the module bypass structure interior wall bypass structure is defined on an outside surface of the print head module that allows an amount of the air and ink to exit the interior cavity of the print head module and reenter the print head module at the vent cavity;

in which the module bypass structure interior wall bypass structure comprises a vent entrance defined through the body at a surface of the print head module.

3. The print head module of claim 2, in which the module bypass structure interior wall bypass structure further comprises a vent channel and a module bypass an interior wall bypass hole defined on the body outside surface and through the surface of the print head module respectively that allows the amount of air and ink exiting the print head module from the vent entrance to bypass exit the interior cavity of the print head module and reenter the print head module via the module bypass interior wall bypass hole at the vent cavity defined within the interior cavity of the print head module.

4. The print head module of claim 1, in which the one-time vent comprises a chemical that causes the one-time vent to swell when the one-time vent comes in contact with an amount of ink.

5. The print head module of claim 4, in which the chemical comprises a crosslinked polyacrylamide, crosslinked polyacrylic acid, polyacrylamide, polyacrylic acid, carboxymethyl cellulose (CMC), styrene maleic anhydride (SMA), or combinations thereof.

6. The print head module of claim 1, in which the one-time vent comprises small pores, in which the sizes of the pores allow ink to pass through the one-time vent while preventing air from passing through the one-time vent.

7. A system for delivering ink to a print head comprising:

a print head;

an external reservoir of ink; and a print head module comprising a one-time vent built into a vent cavity defined within an interior cavity of the print head module, the interior cavity serving as a reservoir of ink and being separated from the vent cavity by an interior wall, the printhead module further comprising an inflatable bladder to control pressure within the printhead module, and the print head module fluidly coupling the print head to the external reservoir of ink; and in which, when an amount of ink comes in contact with the one-time vent within the print head module, air is prevented from passing through the one-time vent.

8. The system of claim 7, in which the module comprises a vent entrance defined on the body of the print head module that allows an amount of air and ink to leave the interior of the print head module when a level of ink within the module reaches the vent entrance.

9. The system of claim 8, in which the module further comprises a vent channel and a module bypass interior wall bypass hole defined on the body of the print head module that allows the amount of air and ink from the vent entrance to bypass the interior wall of the module and reenter the module at the vent cavity defined within the module.

10. The system of claim 7, in which the one-time vent comprises a chemical that causes the one-time vent to swell when the one-time vent comes in contact with an amount of ink.

11. The system of claim 10, in which the chemical comprises a crosslinked polyacrylamide, crosslinked polyacrylic acid, polyacrylamide, polyacrylic acid, carboxymethyl cellulose (CMC), styrene maleic anhydride (SMA), or combinations thereof.

12. A method of bleeding air from a printing device, comprising:

inflating a bladder within a module cavity of a print head module for delivering ink to open a regulator and check valve; and pushing an amount of ink and air from an external reservoir, through a number of ink lines, past the regulator and check valve, and into the print head module until the ink contacts a one-time valve vent located within the print head module;

in which, when an amount of ink comes in contact with the one-time vent, air is prevented from passing through the one-time vent.

13. The method of claim 12, further comprising deflating the bladder by positively pressurizing the interior of the module, releasing the pressure, and burping the print head after deflating the bladder.

14. The method of claim 12, wherein hyperinflation of the bladder within the module causes an amount of ink and air located within the external reservoir to be pushed from the external reservoir and into the module.

15. The method of claim 12, wherein pushing an amount of ink and air from an external reservoir into the print head module until the ink contacts a one-tune vent further comprises pushing the ink and air into a vent cavity defined in the module cavity.

16. The method of claim 15, wherein the vent cavity houses the one-time vent.

17. The method of claim 12, wherein pushing an amount of ink and air from an external reservoir into the print head module until the ink contacts a one-time vent further comprises pushing the ink and air through a module bypass structure defined through an outside surface of the print head module that allows the amount of air and ink to exit the interior of the module and reenter the module at a vent cavity within the module.

18. The method of claim 12, wherein the one-time vent comprises a chemical that causes the one-time vent to swell when the one-time vent comes in contact with an amount of ink.

19. The printhead module of claim 1, wherein the printhead module has a vent entrance defined thereon that connects to the vent cavity, wherein a relative height of the vent entrance on the printhead module corresponds to an amount of ink to be retained within the interior cavity of the printhead module.

* * * * *